US005800153A

United States Patent [19]

DeRoche

[11] Patent Number: 5,800,153

[45] Date of Patent: Sep. 1, 1998

[54] REPETITIVE DETONATION GENERATOR

[75] Inventor: Mark DeRoche, 325 Homer St., Manhattan Beach, Calif. 90266

[73] Assignee: Mark DeRoche, Manhattan Beach, Calif.

[21] Appl. No.: 531,258

[22] Filed: Sep. 20, 1995

[51] Int. Cl.[6] ..... F23C 11/04

[52] U.S. Cl. ..... 431/1; 60/39.77

[58] Field of Search ..... 431/1, 12, 75, 431/173; 60/39.76, 39.77, 39.78, 39.8; 122/24; 432/58

[56] References Cited

U.S. PATENT DOCUMENTS

| | | | |
|---|---|---|---|
| 2,709,890 | 6/1955 | Goddard | 431/1 |
| 4,619,601 | 10/1986 | Sumitani | 431/1 |
| 4,741,154 | 5/1988 | Eidelman . | |
| 4,840,558 | 6/1989 | Saito | 431/1 |
| 5,118,281 | 6/1992 | Bramlette | 431/1 |
| 5,179,246 | 1/1993 | Betts et al. . | |
| 5,239,959 | 8/1993 | Loth et al. . | |
| 5,345,758 | 9/1994 | Bussing . | |
| 5,353,588 | 10/1994 | Richard . | |

FOREIGN PATENT DOCUMENTS

| | | | |
|---|---|---|---|
| 69414 | 4/1985 | Japan | 431/1 |
| 826137 | 5/1981 | U.S.S.R. | 431/1 |

OTHER PUBLICATIONS

D. Helman et al., *Detonation Pulse Engine* (Jun. 16–18, 1986) Huntsville Alabama AIAA/ASME/SAE/ASEE 22nd Joint Propulsion Conference (AIAA–86–1683).

Eric Loth et al., *High Efficiency Detonation Internal Combustion Engine* (Jul. 6–8, 1992) Nashville Tennessee AIAA/SAE/ASME/ASEE 28th Joint Propulsion Conference and Exhibit (AIAA–92–3171).

A. Wortman et al., *Detonation Duct Gas Generator Demonstration Program* (Jul. 6–8, 1992) Nashville Tennessee AIAA/SAE/ASME/ASEE 28th Joint Propulsion Conference and Exhibit (AIAA–92–3174).

G. Carrier et al., *Laser–Initiated Conical Detonation Wave for Supersonic Combustion. III* (Jul. 6–8, 1992) Nashville Tennessee AIAA/SAE/ASME/ASEE 28th Joint Propulsion Conference and Exhibit (AIAA–92–3247).

E. Lynch et al., *Analysis of Flow Processes in the Pulse Detonation Wave Engine* (Jun. 27–29, 1994) Indianapolis Indiana AIAA/ASME/SAE/ASEE 30th Joint Propulsion Conference (AIAA–94–3222).

R. Kynstautas et al., *Measurements of Cell Size in Hydrocarbon–Air Mixtures and Predictions of Critical Tube Diameter, Critical Initiation Energy, and Detonability Limits* (Jul. 3–8 1983) 9th ICODERS Poitiers France 23–37.

J. Nicholls et al., *Feasibility Studies of a Rotating Detonation Wave Rocket Motor* (Jun. 1966) 3(6) J. Spacecraft 893–898.

John H.S. Lee *Dynamic Parameters of Gaseous Detonations* (1984) 16 Ann. Rev. Fluid Mech. 311–331.

O. Peraldi et al., *Criteria for Transition to Detonation in Tubes* (1986) 21st Symposium (International) on Combustion/The Combustion Institute 1629–1637.

(List continued on next page.)

*Primary Examiner*—James C. Yeung
*Attorney, Agent, or Firm*—David G. Beck; Townsend and Townsend and Crew LLP

[57] ABSTRACT

An apparatus and a method for generating repetitive planar detonation waves at varying and controllable frequencies are provided. The apparatus utilizes the over-pressure associated with each detonation wave to interrupt the ambient pressure, post-injection mixing of the reactant gases between the detonation cycles. In-line mechanical valves can be used to positively interrupt one or both reactant gases if the reaction within the detonation tube degrades to deflagrative burning. The detonation system can be optimized during operation by monitoring either the detonation wave pressure or velocity and adjusting the reactant gas mixture accordingly.

15 Claims, 3 Drawing Sheets

OTHER PUBLICATIONS

I. Moen et al., *The Influence of Confinement on the Propagation of Denotations Near the Detonability Limits* (1981) 18th Symposium (International) on Combustion/The Combustion Institute 1615–1622.

H. Matsui et al., *On the Measure of the Relative Detonation Hazards of Gaseous Fuel–Oxygen and Air Mixtures* Colloquium on Fire and Explosion 1269–1280.

John H.S. Lee *Initiation of Gaseous Detonation* (1977) 28(75) Am. Rev. Phys. Chem. 75–104.

R. Dunlap et al., *A Preliminary Study of the Application of Steady–State Detonative Combustion to a Reaction Engine* (Jul. 1958) 28 ARS Journal 451–456.

J. Nicholls et al., *Intermittent Detonation as a Thrust–Producing Mechanism* (May 1957) Jet Propulsion 534–540.

REPETITIVE DETONATION GENERATOR

This application claims the benefit of use Provisional application Ser. No. 60/000,961, filed Jul. 7, 1995.

The present invention relates generally to combustion engines, and more particularly to a method and apparatus for generating repetitive detonations in a combustion chamber.

BACKGROUND OF THE INVENTION

Intermittent combustion engines have been used for decades to generate mechanical energy from the combustion of various fuel sources. Typically these engines rely on a deflagration process in which a mixture of fuel and an oxidizer are burned and some form of mechanical apparatus is used to harness the energy released during the mixture's combustion.

Detonation combustion differs from deflagration combustion in that the fuel/oxidixer mixture is detonated rather than burned. Detonation combustion leads to a much greater release of energy, the energy taking the form of greater pressures, higher temperatures, and much greater reaction velocities. Thus while the reaction velocity due to a deflagration process is on the order of 1 meter per second and develops negligible pressure, the reaction velocity associated with detonation combustion typically approaches 2000 meters per second and offers pressure differentials of approximately 20 bars.

Although many of the principles of detonation theory were derived in the 1800's by Chapman and Jouguet, it has been during the last thirty years that significant strides have been made in the design and implementation of systems capable of harnessing the higher efficiencies offered by detonation systems. In a series of experiments published at the 22nd Joint Propulsion Conference in 1986, Hellman et al. demonstrated a detonation reaction engine capable of direct initiation of intermittent detonations. In the disclosed apparatus a spark is introduced into a small chamber containing a detonable fuel and oxidizer mixture in order to initiate a detonation wave. The detonation wave produced by this process is then used to detonate a larger detonation cycle within a subsequent chamber. To prevent the possibility of the detonation reaction passing from the detonation chamber through the mechanical inlet valve and into the chamber or tank containing the gas mixture, the inlet valve must be closed prior to the firing of the spark. This limits the potential operating frequency of the disclosed system to the maximum cycling frequency of the mechanical valves, or approximately 25 Hertz. Unfortunately most applications (e.g., repetitive detonation engines) require at least an order of magnitude higher operating frequencies. Furthermore, due to the exposure of the mechanical valves to the high temperatures associated with the detonation process, the system is limited to an operational period on the order of a few minutes. Thus while these experiments demonstrated the initiation capabilities of a small predetonation wave, the disclosed apparatus is of limited practicality due to the use of premixed gases as well as its reliance on mechanical valves.

In U.S. Pat. Nos. 5,345,758 and 5,353,588, Thomas Bussing discloses a detonation system which incorporates several individual detonation chambers. This system utilizes a rotary valve to control the feed of premixed gas into the adjacent combustion chambers. As with the Hellman device, the maximum cycling frequency of the Bussing engine is limited by the operational frequency of the mechanical valves.

From the foregoing, it is apparent that a method of initiating a sustainable intermittent detonation combustion engine capable of operating at high frequencies is desired.

SUMMARY OF THE INVENTION

The present invention provides an apparatus and method for repetitively initiating detonations within a detonation tube at relatively high frequencies.

In the present invention, the gases used to support the detonation reaction are not premixed, rather they are individually injected into the detonation tube. The injection orifices are arranged to promote rapid mixing of the gases upon entry into the detonation tube. After the volume of the injected gases approximately equals the volume of the detonation tube, an initiation energy is introduced into the tube to initiate a detonation reaction. Although it is preferable to provide sufficient energy to directly initiate the reaction, a deflagration reaction can be initiated which then transitions into a detonation reaction. The overpressure associated with the detonation reaction interrupts the flow of reactants into the tube, this interruption continuing as long as the pressure within the tube is greater than the gas pressure at the inlet orifices. Once the detonation wave is exhausted out of the detonation tube, an underpressure is created and the flow of reactants through the injection orifices resumes in preparation for another detonation cycle.

In one embodiment of the invention a sensor is provided which detects the existence of a combustion reaction within the detonation tube. In the preferred embodiment the sensor is a remotely mounted optical sensor which is optically coupled to the detonation tube using an optical fiber. The output of the sensor in this embodiment is coupled to a microcontroller which controls the initiation source as well as a mechanical valve in line with each of the reactant sources. If it is determined that burning is still occurring in the detonation tube after the detonation wave has been exhausted then one or both of the mechanical valves are cycled in order to extinguish the burning prior to initiating the next detonation cycle.

In another embodiment of the invention a sensor is provided within the detonation tube which is capable of determining detonation wave pressure or velocity. Utilizing either of these parameters a microcontroller coupled to the sensor calculates the system's performance. The microcontroller then optimizes the fuel/oxidizer mixture using either in-line pressure or flow regulators for each of the reactants.

A further understanding of the nature and advantages of the present invention may be realized by reference to the remaining portions of the specification and the drawings.

DESCRIPTION OF SPECIFIC EMBODIMENTS

Figure 1:
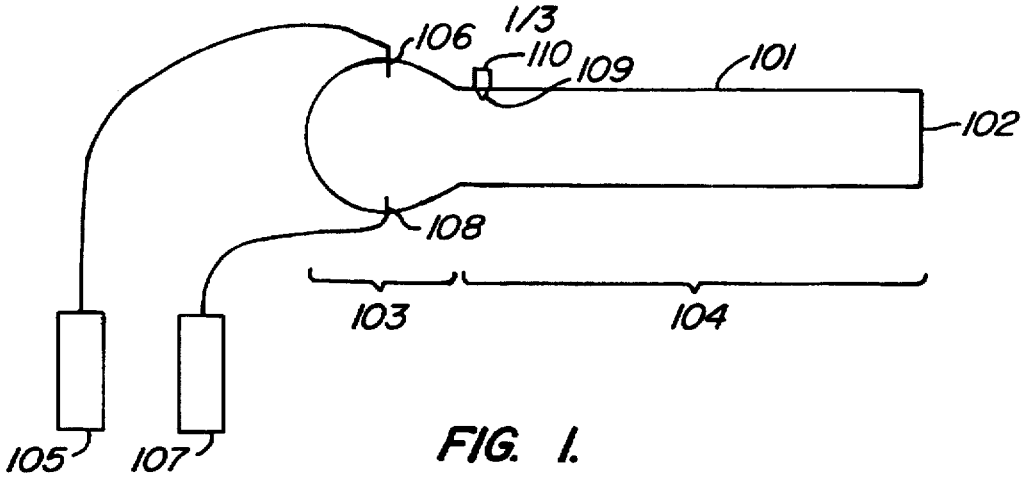
FIG. 1 is an illustration of the basic configuration of one embodiment of the present invention.

FIG. 1 is an illustration of one embodiment of the invention utilizing a detonation tube 101 which is open at end 102. Detonation tube 101 is comprised of a first portion 103 and a second portion 104. Fuel from a fuel tank 105 is introduced into portion 103 through an injection orifice 106. Oxidizer from a second source tank 107 is introduced into portion 103 through an injection orifice 108. The orifice diameters of orifices 106 and 108 depend upon the reactants being used. In one embodiment of the invention utilizing a hydrogen/oxygen mixture, the orifice diameters for the hydrogen and oxygen injectors are 0.102 and 0.142 centimeters, respectively. The fuel and oxidizer gases mix within portion 103. After the gases have become suitably mixed, initiation energy is introduced at a point 109. In this embodiment, the initiation energy is introduced by a spark plug 110. Due to the cross-sectional shape of tube 101, the detonation of the gases causes the formation of a planar detonation wave traversing through tube 101 at very high pressure, temperature and velocity. The detonation wave is essentially a shock wave which is supported by the unconsumed gases which lie in front of it. The detonation wave continues traveling toward end 102, consuming the mixed gasses in front of it, which in turn continue to support its propagation.

Figure 2A:
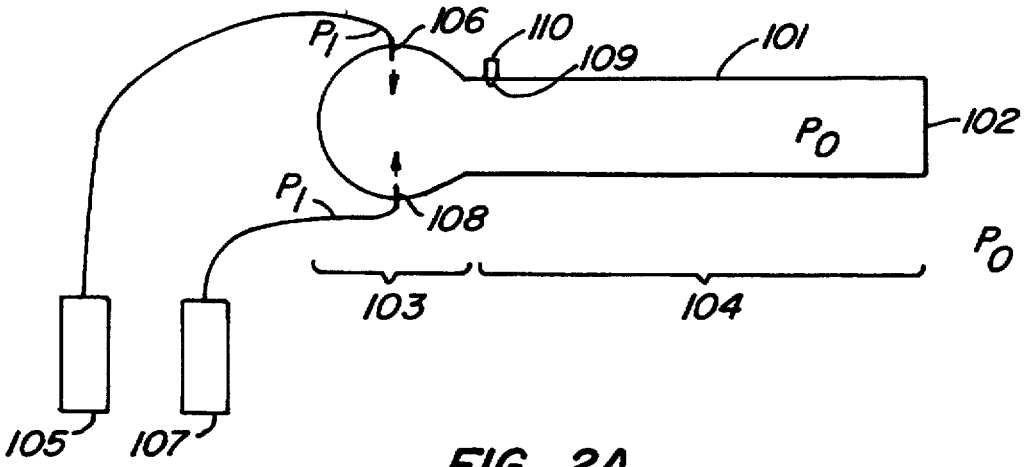
FIGS. 2A–D illustrate one cycle of an intermittent detonation reaction according to the present invention.

FIGS. 2A–D illustrate one cycle of an intermittent detonation reaction according to the present invention. FIG. 2A is the same embodiment of the invention as shown in FIG. 1 at a time $t_1$. At time $t_1$ fuel is injected through orifice 106 and oxidizer is injected through orifice 108 into portion 103 of tube 101. Flow of fuel and oxidizer is insured by keeping the pressure, $P_1$, in tanks 105 and 107 greater than the ambient pressure, $P_0$, in detonation tube 101. Preferably injection orifices 106 and 108 are arranged to promote mixing of the two gases. For example, by placing the two orifices on the same axis and on opposite sides of tube 101, as the gases exit the orifices and enter the mixing portion 103 of tube 101, they directly impinge upon each other and turbulently mix together. In another design the orifices are positioned such that the gases enter mixing portion 103 tangentially, this design also promoting mixing. Various other methods well known by those skilled in the art, such as a Shchelkin Spiral, can be used to enhance the mixing. As tube 101 is open at end 102, the gases mix together at the ambient pressure, $P_0$, of the surroundings.

Figure 2B:
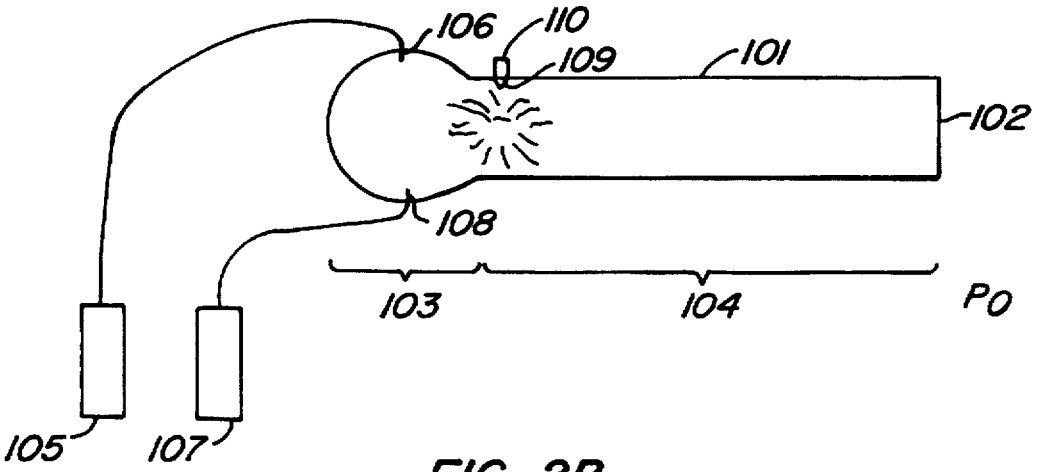

At time $t_2$, illustrated in FIG. 2B, the volume of the two injected gases equals the volume of detonation tube 101. At this time an initiating energy is introduced into tube 101 at point 109 thereby initiating a detonation reaction of the stoichiometric mixture of fuel and oxidizer gases within tube 101. As a result, a planar detonation wave is formed which proceeds through the tube, unconsumed gases supporting the continued propagation of the wave.

Figure 2C:
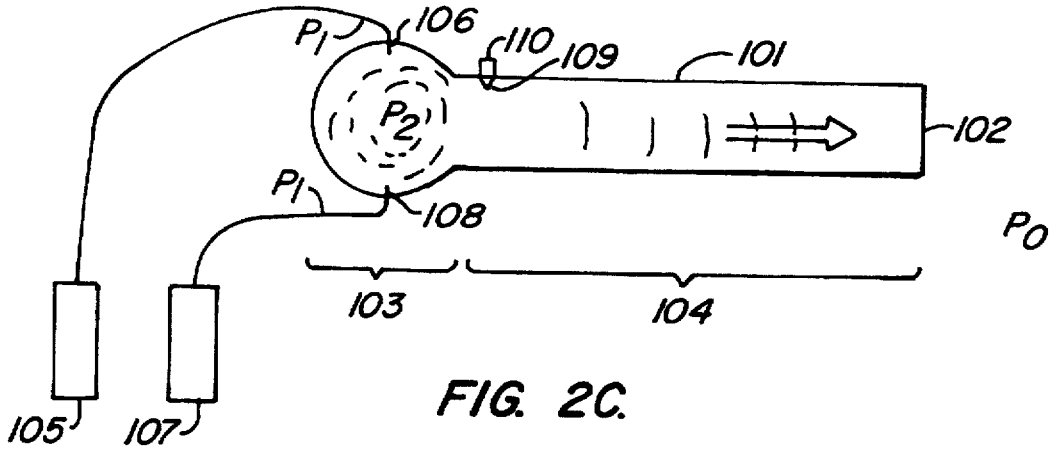

As illustrated in FIG. 2C, the detonation reaction and the subsequent shock wave causes a large overpressure, $P_2$, within tube 101. The overpressure of the detonation reaction stops the flow of fuel and oxidizer into tube 101 at injection orifices 106 and 108 as long as $P_2$ is greater than $P_1$. The interruption in the flow of inlet gases assures that the reaction does not degrade to continuous deflagrative burning of the inlet gases. Continuous deflagrative burning of the inlet gases would prevent the initiation of a subsequent detonation cycle. There is no concern that due to the overpressure condition the reaction may proceed through an injection orifice and into one of the source tanks since neither the fuel nor the oxidizer can independently support the combustion process.

Figure 2D:
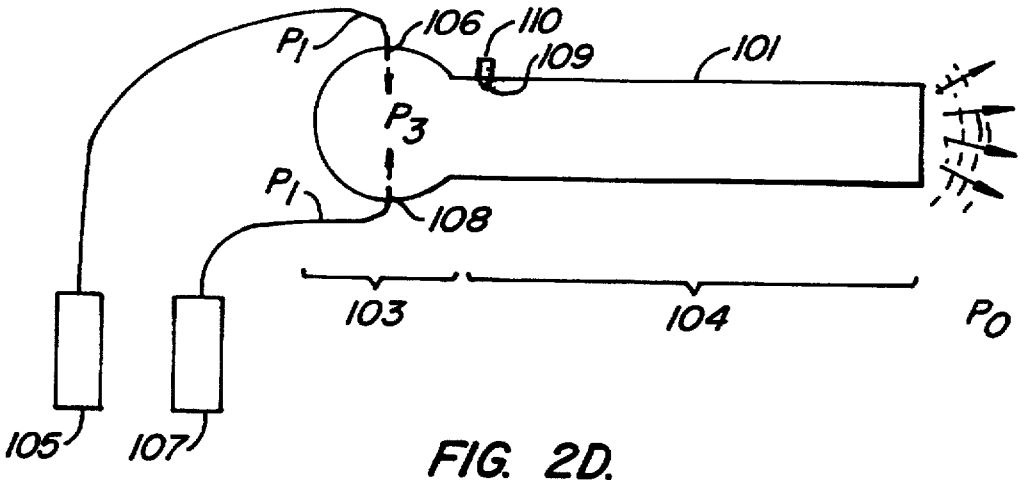

As the detonation wave progresses down the tube it creates significant rarefaction waves traveling in the same direction, these waves helping to scavenge the exhaust products from the tube. Furthermore, as illustrated in FIG. 2D, the progression of the detonation wave and the continued consumption of the usable gas mixture contained within tube 101 leads to a reduction in the reaction pressure. Finally, as the detonation wave traverses the full length of tube 101 it exhausts its energy as well as the reaction products out end 102. This action creates an underpressure $P_3$, $P_3$ being less than ambient pressure $P_0$. Once the pressure in tube 101 drops below $P_1$, the filling of the detonation tube with fuel and oxidizer through injection orifices 106 and 108 resumes. At this point in time the system has undergone a complete cycle and is beginning the next cycle.

Figure 3:
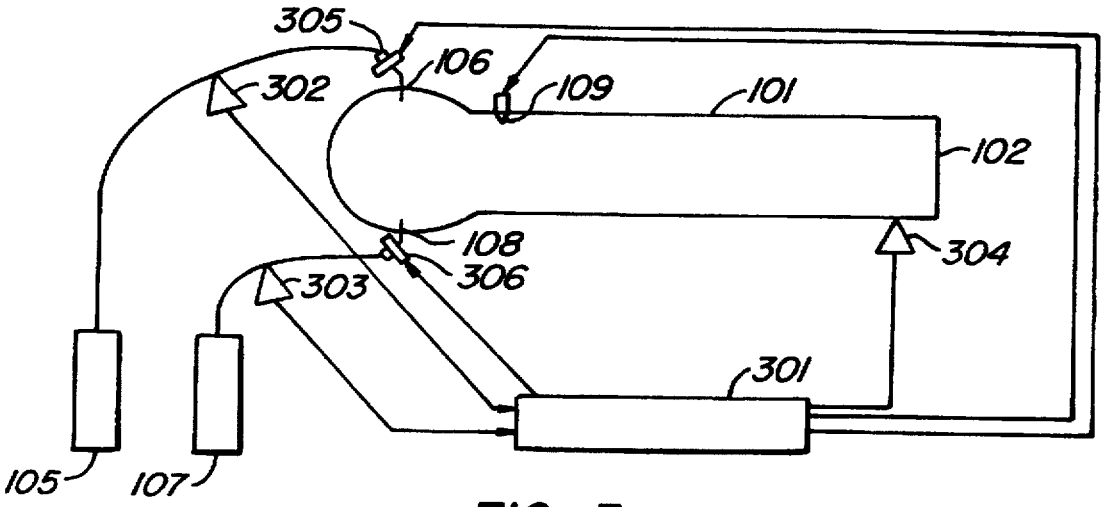
FIG. 3 is an illustration of the preferred embodiment of the invention.

FIG. 3 is an illustration of the preferred embodiment of the invention. As in the system illustrated in FIG. 1, this apparatus is comprised of detonation tube 101 divided into portions 103 and 104, injection orifices 106 and 108, fuel and oxidizer tanks 105 and 107, and initiation firing plug 110. In this embodiment a microcontroller 301 is used to control the detonation process by regulating the firing of initiation source 110.

Prior to firing source 110, microcontroller 301 determines whether the volume of the injected gases within detonation tube 101 equals the known volume of detonation tube 101. Microcontroller 301 calculates the volume of the injected gases based on the respective pressures of the fuel and oxidizer sources, the injection orifice diameters, and the properties of the fuel and the oxidizer. The necessary pressure information is provided by pressure sensors 302 and 303 situated between the source tanks and the injection orifices.

After the completion of the initial detonation cycle and prior to the initiation of each subsequent detonation cycle, microcontroller 301 confirms that all burning within detonation tube 101 has ceased using a sensor 304. Sensor 304 can be a pressure, ion, or optical sensor since all three are capable of quickly and accurately sensing the existence of a combustion reaction within the tube. Sensor 304 is positioned such that it is able to detect the existence of a detonation or flame within tube 101. In the preferred embodiment, sensor 304 is an optical sensor which is remotely mounted and connected to tube 101 via a fiber optic (not shown).

If microcontroller 301 determines that there is still burning taking place in tube 101 after the detonation wave has been exhausted through end 102, then prior to the initiation of the next cycle either one or both mechanical cutoff valves 305 and 306 are positively cycled. Mechanical valves 305 and 306 are situated between the source tanks and the injection orifices. Cycling of either valve 305 or 306 extinguishes the burning by eliminating one of the necessary combustion components. However it may be preferable, depending upon the sources in use, to cycle both valves to insure that the proper stoichiometric mixture of fuel and oxidizer is quickly achieved upon valve opening. Mechanical shutoff valves 305 and 306 are only used if a flame is present, not during routine system operation. Microcontroller 301 can be programmed to alternate between valves 305 and 306, prolonging each valves' life by minimizing their use.

Figure 4:
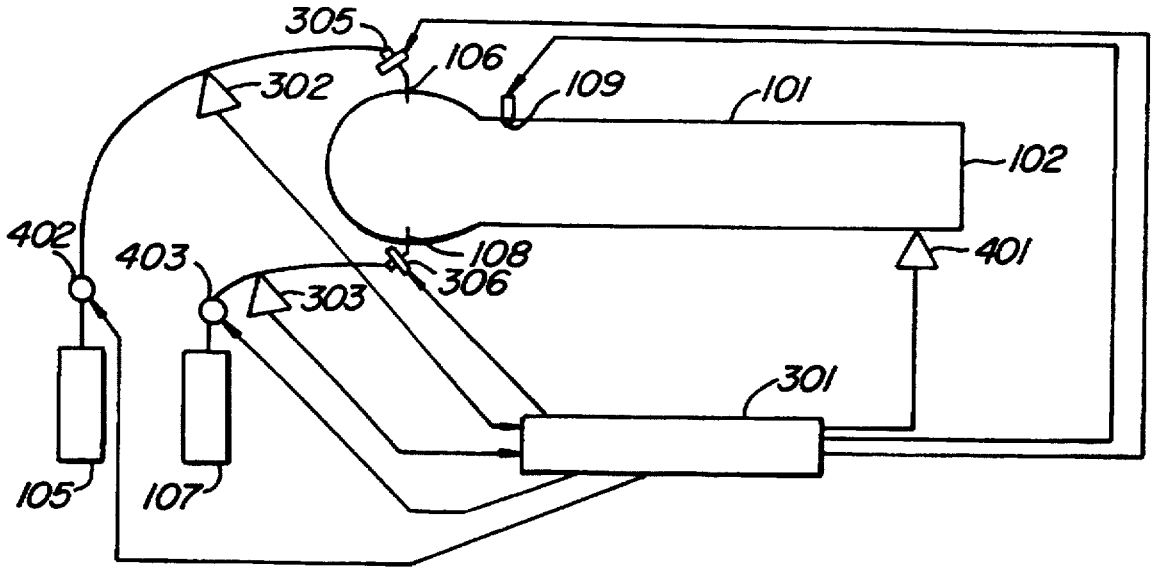
FIG. 4 is an illustration of an embodiment which includes means for monitoring the detonation reaction's performance and optimizing the reactant mixture accordingly.

In an alternate embodiment illustrated in FIG. 4, sensor 304 is replaced with a sensor 401. In addition to providing information regarding burning within tube 101, sensor 401 is also capable of providing detonation wave pressure or velocity information. Since the pressure and velocity of a detonation wave is a function of the ratio of the fuel/oxidizer mixture, the information provided by sensor 401 can be used by microcontroller 301 to determine useful information regarding the detonation system's performance. This embodiment of the invention also includes pressure regulators 402 and 403 mounted between the source tanks and the injection orifices. Based upon the information provided by sensor 401, the fuel/oxidizer mixture can be changed in order to optimize the system's performance. Pressure regulators 402 and 403 can be replaced with flow regulators. The flow regulators can either take the form of variable injection orifices or regulators mounted directly within the source delivery lines.

Figure 5:
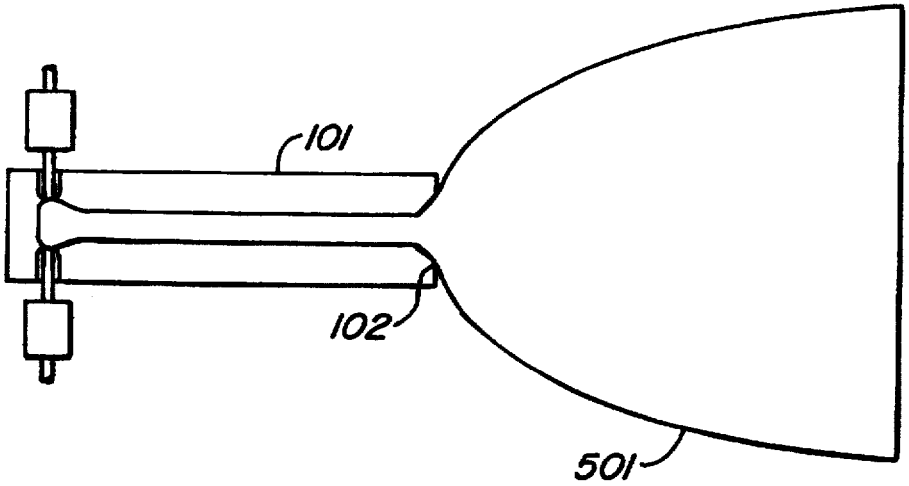
FIG. 5 is an illustration of an embodiment of the invention which includes an exhaust nozzle attached to an open end of the detonation tube.

In another embodiment of the invention illustrated in FIG. 5, an exhaust nozzle 501 is attached to open end 102 bf detonation tube 101. The end of detonation tube 101 can either be formed into the nozzle, or a separate nozzle attachment can be used. The latter approach offers increased flexibility. The addition of exhaust nozzle 501 acts to expand each exhausting detonation wave, thereby efficiently converting its pressure and energy into reactive thrust.

The present invention is not limited to a spark plug for initiating the detonation reaction. Rather, any means which supplies sufficient energy to either directly initiate the detonation reaction or to initiate a deflagration reaction which can then transition into a detonation reaction can be used. For example, energy can be optically relayed from a source into the detonation tube. A laser is an ideal source due to its high fluence levels as well as the ease by which it can be relayed and focussed at the desired initiation point. The location of the initiation within the detonation tube is not critical, although it can affect the system's performance. In the preferred embodiment, the initiation site is determined experimentally for a specific tube geometry, reactant mixture, and initiation energy.

In the preferred embodiment, the minimum initiation energy is determined experimentally. However, R. Knystautas et al. published the critical initiation energies for a variety of fuel mixtures in an article entitled *Measurements of Cell Size in Hydrocarbon-Air Mixtures and Predictions of Critical Tube Diameter, Critical Initiation Energy, and Detonability Limits*, presented at the 9th ICODERS, Poitiers, France, Jul. 3–8, 1983. The minimum initiation energies for a various reactants have also been published by numerous other authors.

The criteria for the stable propagation of a detonation wave in a detonation tube is well known by those skilled in the art. The tube diameter, d, should be approximately equivalent to the detonation cell size, $\lambda$, divided by $\pi$. The detonation cell size is a characteristic of a detonation front which is unique to a particular mixture of reactants. It is typically determined experimentally through smoked foil measurements or by measuring the pressure fluctuations detected by fast-response transducers. Based upon the stoichiometric mixture of hydrogen and air used in one embodiment of the present invention, the mixture having an average cell size of approximately 1.57 centimeters, the critical detonation tube diameter is 0.5 centimeters. Note that for a reactant mixture of methane and air which has a much larger characteristic cell size, the critical detonation tube size would be over 10 centimeters.

Another characteristic of the detonation tube is the tube length. If direct detonation initiation is used the length of the detonation tube is not a critical dimension and can in fact be quite short. However, if the initiation energy is insufficient for direct initiation then the tube length must be much longer in order to accommodate the transition from the deflagration reaction to the detonation reaction. In one embodiment of the present invention utilizing hydrogen and oxygen as the reactants, a tube length of 17.75 centimeters is used.

Figure 6:
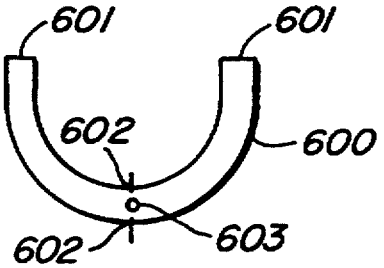
FIG. 6 is an illustration of an embodiment of the invention in which the detonation tube has two open ends aimed in approximately the same direction.

In the preferred embodiment of the present invention, one end of the detonation tube is closed as illustrated in FIGS. 1–5. However, in some applications of the present invention it may be desirable to have both ends of the tube open. FIG. 6 is an illustration of an embodiment in which a detonation tube 600 is shaped in the form of a U such that both open ends 601 are aimed in the same direction. The reactants are injected at orifices 602 and the initiation energy is applied at a point 603.

As will be understood by those familiar with the art, the present invention may be embodied in other specific forms without departing from the spirit or essential characteristics thereof. Accordingly, disclosure of the preferred embodiment of the invention is intended to be illustrative, but not limiting, of the scope of the invention which is set forth in the following claims.

I claim:

1. A repetitive detonation generator comprising:

a detonation tube;

a first injection orifice coupled to said detonation tube for injecting a fuel supplied by a fuel source into said detonation tube, said fuel having a first pressure at said first orifice;

a second injection orifice coupled to said detonation tube for injecting an oxidizer supplied by an oxidizer source into said detonation tube, said oxidizer having a second pressure at said second orifice;

a detonation initiator for supplying an initiation energy to a mixture of said fuel and said oxidizer within said detonation tube, said initiation energy causing a detonation reaction, wherein a detonation wave is formed by said detonation reaction, said detonation wave temporarily creating a third pressure in said detonation tube and temporarily interrupting a flow of said fuel and a flow of said oxidizer into said detonation tube, wherein said third pressure is greater then said first and second pressures;

a mechanical valve interposed between said first injection orifice and said fuel source;

a sensor coupled to said detonation tube, said sensor outputting a signal when combustion is detected within said detonation tube; and a controller coupled to said sensor and coupled to said mechanical valve, said controller causing said mechanical valve to interrupt said flow of said fuel through said first injection orifice if said controller receives said signal from said sensor after said detonation wave has been exhausted from said detonation tube, said mechanical valve continuing to interrupt said flow of fuel until no further combustion is detected by said sensor.

2. The repetitive detonation generator of claim 1, further comprising:

a sensor coupled to said detonation tube, said sensor detecting a pressure associated with said detonation wave, wherein said sensor outputs a signal corresponding to said pressure;

a first regulator associated with said fuel, said first regulator regulating a quantity of said fuel injected into said detonation tube;

a second regulator associated with said oxidizer, said second regulator regulating a quantity of said oxidizer injected into said detonation tube; and a controller coupled to said sensor and said first and second regulators, wherein said controller optimizes said mixture by regulating said fuel flow and said oxidizer flow using said first and second regulators, said optimized mixture determined by said controller from said sensor output signal.

3. A repetitive detonation generator comprising:

a detonation tube;

a first injection orifice coupled to said detonation tube for injecting a fuel supplied by a fuel source into said detonation tube, said fuel having a first pressure at said first orifice;

a second injection orifice coupled to said detonation tube for injecting an oxidizer supplied by an oxidizer source into said detonation tube, said oxidizer having a second pressure at said second orifice; and a detonation initiator for supplying an initiation energy to a mixture of said fuel and said oxidizer within said detonation tube, said initiation energy causing a detonation reaction, wherein a detonation wave is formed by said detonation reaction, said detonation wave temporarily creating a third pressure in said detonation tube and temporarily interrupting a flow of said fuel and a flow of said oxidizer into said detonation tube, wherein said third pressure is greater then said first and second pressures;

a mechanical valve interposed between said second injection orifice and said oxidizer source;

a sensor coupled to said detonation tube, said sensor outputting a signal when combustion is detected within said detonation tube; and a controller coupled to said sensor and coupled to said mechanical valve, said controller causing said mechanical valve to interrupt said flow of said oxidizer through said second injection orifice if said controller receives said signal from said sensor after said detonation wave has been exhausted from said detonation tube, said mechanical valve continuing to interrupt said flow of oxidizer until no further combustion is detected by said sensor.

4. The repetitive detonation generator of claim 3, further comprising:

a sensor coupled to said detonation tube, said sensor detecting a pressure associated with said detonation wave, wherein said sensor outputs a signal corresponding to said pressure;

a first regulator associated with said fuel, said first regulator regulating a quantity of said fuel injected into said detonation tube;

a second regulator associated with said oxidizer, said second regulator regulating a quantity of said oxidizer injected into said detonation tube; and a controller coupled to said sensor and said first and second regulators, wherein said controller optimizes said mixture by regulating said fuel flow and said oxidizer flow using said first and second regulators, said optimized mixture determined by said controller from said sensor output signal.

5. A repetitive detonation generator comprising:

a detonation tube;

a first injection orifice coupled to said detonation tube for injecting a fuel supplied by a fuel source into said detonation tube, said fuel having a first pressure at said first orifice;

a second injection orifice coupled to said detonation tube for injecting an oxidizer supplied by an oxidizer source into said detonation tube, said oxidizer having a second pressure at said second orifice;

a detonation initiator for supplying an initiation energy to a mixture of said fuel and said oxidizer within said detonation tube, said initiation energy causing a detonation reaction, wherein a detonation wave is formed by said detonation reaction, said detonation wave temporarily creating a third pressure in said detonation tube and temporarily interrupting a flow of said fuel and a flow of said oxidizer into said detonation tube, wherein said third pressure is greater then said first and second pressures;

a first mechanical valve interposed between said first injection orifice and said fuel source;

a second mechanical valve interposed between said second injection orifice and said oxidizer source;

a sensor coupled to said detonation tube, said sensor outputting a signal when combustion is detected within said detonation tube; and a controller coupled to said sensor and coupled to said first and second mechanical valves, said controller causing said first mechanical valve to interrupt said flow of said fuel through said first injection orifice and causing said second mechanical valve to interrupt said flow of said oxidizer through said second injection orifice if said controller receives said signal from said sensor after said detonation wave has been exhausted from said detonation tube, said first mechanical valve continuing to interrupt said flow of said fuel and said second mechanical valve continuing to interrupt said flow of said oxidizer until no further combustion is detected by said sensor.

6. A repetitive detonation generator comprising:

a detonation tube;

a first injection orifice coupled to said detonation tube for injecting a fuel supplied by a fuel source into said detonation tube, said fuel having a first pressure at said first orifice;

a second injection orifice coupled to said detonation tube for injecting an oxidizer supplied by an oxidizer source into said detonation tube, said oxidizer having a second pressure at said second orifice;

a detonation initiator for supplying an initiation energy to a mixture of said fuel and said oxidizer within said detonation tube, said initiation energy causing a detonation reaction, wherein a detonation wave is formed by said detonation reaction, said detonation wave temporarily creating a third pressure in said detonation tube and temporarily interrupting a flow of said fuel and a flow of said oxidizer into said detonation tube, wherein said third pressure is greater then said first and second pressures;

a first sensor interposed between said fuel source and said first injection orifice, said first sensor detecting a fuel pressure;

a second sensor interposed between said oxidizer source and said second injection orifice, said second sensor detecting an oxidizer pressure; and a controller coupled to said detonation initiator and to said first and second sensors, said controller determining a time when a volume of said mixture is equivalent to a volume of said detonation tube, wherein said controller prevents said detonation initiator from supplying said initiation energy until said time is reached.

7. A repetitive detonation generator comprising:

a detonation tube;

a first injection orifice coupled to said detonation tube for injecting a fuel supplied by a fuel source into said detonation tube, said fuel having a first pressure at said first orifice;

a second injection orifice coupled to said detonation tube for injecting an oxidizer supplied by an oxidizer source into said detonation tube, said oxidizer having a second pressure at said second orifice;

a detonation initiator for supplying an initiation energy to a mixture of said fuel and said oxidizer within said detonation tube, said initiation energy causing a detonation reaction, wherein a detonation wave is formed by said detonation reaction, said detonation wave temporarily creating a third pressure in said detonation tube and temporarily interrupting a flow of said fuel and a flow of said oxidizer into said detonation tube, wherein said third pressure is greater then said first and second pressures;

a sensor coupled to said detonation tube, said sensor detecting a velocity associated with said detonation wave, wherein said sensor outputs a signal corresponding to said velocity;

a first regulator associated with said fuel, said first regulator regulating a quantity of said fuel injected into said detonation tube;

a second regulator associated with said oxidizer, said second regulator regulating a quantity of said oxidizer injected into said detonation tube; and a controller coupled to said sensor and said first and second regulators, wherein said controller optimizes said mixture by regulating said fuel flow and said oxidizer flow using said first and second regulators, said optimized mixture determined by said controller from said sensor output signal.

8. The repetitive detonation generator of claim 7, wherein said first and second regulators are selected from the group consisting of pressure regulators and flow regulators.

9. A method of cycling a repetitive detonation generator, said method comprising the steps of:

injecting through a first injection orifice in a detonation tube a fuel supplied by a fuel source, said fuel entering said detonation tube at a first pressure;

injecting through a second injection orifice in said detonation tube an oxidizer supplied by an oxidizer source, said oxidizer entering said detonation tube at a second pressure;

initiating a detonation reaction within said detonation tube by providing an initiating energy to a mixture of said fuel and said oxidizer within said detonation tube;

temporarily interrupting a flow of said fuel through said first injection orifice and a flow of said oxidizer through said second injection orifice by overpressuring said detonation tube, said overpressure due to a detonation wave formed by said detonation reaction, said overpressure greater then said first and second pressures; and determining whether there is combustion within said detonation tube after said detonation wave has been exhausted from said detonation tube, and if combustion within said detonation tube is detected after said detonation wave has been exhausted from said detonation tube, temporarily interrupting said flow of said fuel through said first injection orifice with a mechanical valve interposed between said first injection orifice and a fuel source, said interruption continuing until no further combustion is detected within said detonation tube.

10. The method of claim 9, further comprising the steps of:

detecting a pressure associated with said detonation wave; and optimizing said mixture of said fuel and said oxidizer on the basis of said detonation wave pressure.

11. A method of cycling a repetitive detonation generator, said method comprising the steps of:

injecting through a first injection orifice in a detonation tube a fuel supplied by a fuel source, said fuel entering said detonation tube at a first pressure;

injecting through a second injection orifice in said detonation tube an oxidizer supplied by an oxidizer source, said oxidizer entering said detonation tube at a second pressure;

initiating a detonation reaction within said detonation tube by providing an initiating energy to a mixture of said fuel and said oxidizer within said detonation tube;

temporarily interrupting a flow of said fuel through said first injection orifice and a flow of said oxidizer through said second injection orifice by overpressuring said detonation tube, said overpressure due to a detonation wave formed by said detonation reaction, said overpressure greater then said first and second pressures; and determining whether there is combustion within said detonation tube after said detonation wave has been exhausted from said detonation tube, and if combustion within said detonation tube is detected after said detonation wave has been exhausted from said detonation tube, temporarily interrupting said flow of said oxidizer through said second injection orifice with a mechanical valve interposed between said second injection orifice and an oxidizer source, said interruption continuing until no further combustion is detected within said detonation tube.

12. The method of claim 11, further comprising the steps of:

detecting a pressure associated with said detonation wave; and optimizing said mixture of said fuel and said oxidizer on the basis of said detonation wave pressure.

13. A method of cycling a repetitive detonation generator, said method comprising the steps of:

injecting through a first injection orifice in a detonation tube a fuel supplied by a fuel source, said fuel entering said detonation tube at a first pressure;

injecting through a second injection orifice in said detonation tube an oxidizer supplied by an oxidizer source, said oxidizer entering said detonation tube at a second pressure;

initiating a detonation reaction within said detonation tube by providing an initiating energy to a mixture of said fuel and said oxidizer within said detonation tube;

temporarily interrupting a flow of said fuel through said first injection orifice and a flow of said oxidizer through said second injection orifice by overpressuring said detonation tube, said overpressure due to a detonation wave formed by said detonation reaction, said overpressure greater then said first and second pressures; and determining whether there is combustion within said detonation tube after said detonation wave has been exhausted from said detonation tube, and if combustion within said detonation tube is detected after said detonation wave has been exhausted from said detonation tube, temporarily interrupting said flow of said fuel through said first injection orifice with a first mechanical valve interposed between said first injection orifice and a fuel source and temporarily interrupting said flow of said oxidizer through said second injection orifice with a second mechanical valve interposed between said second injection orifice and an oxidizer source, said interruptions continuing until no further combustion is detected within said detonation tube.

14. A method of cycling a repetitive detonation generator, said method comprising the steps of:

injecting through a first injection orifice in a detonation tube a fuel supplied by a fuel source, said fuel entering said detonation tube at a first pressure;

injecting through a second injection orifice in said detonation tube an oxidizer supplied by an oxidizer source, said oxidizer entering said detonation tube at a second pressure;

initiating a detonation reaction within said detonation tube by providing an initiating energy to a mixture of said fuel and said oxidizer within said detonation tube;

temporarily interrupting a flow of said fuel through said first injection orifice and a flow of said oxidizer through said second injection orifice by overpressuring said detonation tube, said overpressure due to a detonation wave formed by said detonation reaction, said overpressure greater then said first and second pressures; and preventing said initiating step until a time when a volume of said mixture is equivalent to a volume of said detonation tube.

15. A method of cycling a repetitive detonation generator, said method comprising the steps of:

injecting through a first injection orifice in a detonation tube a fuel supplied by a fuel source, said fuel entering said detonation tube at a first pressure;

injecting through a second injection orifice in said detonation tube an oxidizer supplied by an oxidizer source, said oxidizer entering said detonation tube at a second pressure;

initiating a detonation reaction within said detonation tube by providing an initiating energy to a mixture of said fuel and said oxidizer within said detonation tube;

temporarily interrupting a flow of said fuel through said first injection orifice and a flow of said oxidizer through said second injection orifice by overpressuring said detonation tube, said overpressure due to a detonation wave formed by said detonation reaction, said overpressure greater then said first and second pressures;

detecting a velocity associated with said detonation wave; and optimizing said mixture of said fuel and said oxidizer on the basis of said detonation wave velocity.

* * * * *